US005741075A

United States Patent [19]

Collins et al.

[11] Patent Number: 5,741,075

[45] Date of Patent: Apr. 21, 1998

[54] RECLOSABLE PACKAGING

[75] Inventors: Ross Collins, Buckingham, England; James Andrew Colwill, Schwellbrunn, Switzerland

[73] Assignee: Allied Bakeries Limited, London

[21] Appl. No.: 718,102

[22] Filed: Sep. 18, 1996

[30] Foreign Application Priority Data

Sep. 19, 1995 [GB] United Kingdom ..... 9519137

[51] Int. Cl.[6] ..... B65D 33/34

[52] U.S. Cl. ..... 383/5; 383/61; 383/81; 383/204

[58] Field of Search ..... 383/203, 204, 383/207, 209, 61, 62, 66, 67, 78, 81, 82, 83, 88, 89, 5

[56] References Cited

U.S. PATENT DOCUMENTS

| | | | |
|---|---|---|---|
| 2,153,310 | 4/1939 | Newman | 383/89 X |
| 2,635,788 | 4/1953 | Snyder et al. | 383/209 X |
| 3,093,292 | 6/1963 | Ahlbor | 383/203 X |
| 3,388,789 | 6/1968 | Simandl et al. | 383/81 X |
| 3,711,011 | 1/1973 | Kugler | 383/211 X |
| 4,066,167 | 1/1978 | Hanna et al. | 383/62 X |
| 4,911,563 | 3/1990 | Ciani | 383/89 |
| 5,029,712 | 7/1991 | O'Brien et al. | 383/203 X |
| 5,035,518 | 7/1991 | McClintock | 383/66 X |
| 5,582,889 | 12/1996 | Pedrini | 383/81 X |

FOREIGN PATENT DOCUMENTS

| | | | |
|---|---|---|---|
| 916634 | 8/1954 | Germany | 383/78 |

*Primary Examiner*—Jes F. Pascua
*Attorney, Agent, or Firm*—Tim Headley; Haynes and Boone, L.L.P.

[57] ABSTRACT

A package comprises a flexible bag (1) and a label (2), the bag having a closed end (3). The closed end is openable to provide an opening (12) for access to the contents of the package and reclosable by means of the label (2). The label (2) has on one face two areas (8, 9) of adhesive separated by a non-adhesive area (10), the adhesive areas (8, 9) being adapted to adhere to the package (1) one to each side of the opening (12) such that said non-adhesive area (10) extends over the opening.

5 Claims, 2 Drawing Sheets

RECLOSABLE PACKAGING

This invention relates to reclosable packaging and, more particularly, to reclosable packaging suitable for bakery products such as bread. Hereinafter, the invention will be described in relation to packaging for bread, but is not intended to be limited to such packaging.

Previously, bread has commonly been packaged in a flexible plastics bag having an open end. The bag is considerably longer than the loaf of bread to be packaged. The excess length of bag at the open end is radially compressed to close the bag adjacent the loaf and is then held together by means of a tie which encircles the bag at the compressed area. Such a package is operable simply by removing the tie and is reclosable by reapplication of the tie. However, there are a number of disadvantages associated with such packages. In particular, the tie may wear or become distorted with repeated use and will then become ineffective. The tie is also small and may therefore be difficult to operate. As the bread is used there is more and more excess packaging which is difficult to handle.

In addition, there has to be a significant excess length of bag compared to the unused loaf, to enable the bag to be closed and the tie fitted. That excess length uses a considerable amount of plastics material, and thus adds to the expense of the packaging.

The present invention is aimed at overcoming the above disadvantages and also has a number of other advantages.

According to the present invention there is provided a package comprising a flexible bag and a label, the bag having a closed end, said end being openable to provide an opening for access to the contents of the package and reclosable by means of said label, the label having on one face two areas of adhesive separated by a non-adhesive area, the adhesive areas being adapted to adhere to the package one to each side of the opening such that said non-adhesive area extends over the opening.

The closed end of the package is preferably initially sealed by means of a heat seal or in any other appropriate way. The seal may be provided with a line of perforations for ease of opening and the line of perforations may form an initial tear-off strip which has the additional advantage of providing tamper evidence.

The bag of the present invention does not require so much excess plastics material as the prior art bags discussed above and is therefore easier to handle and less expensive to produce.

In a preferred embodiment of the present invention, the label is initially positioned over the sealed end of the bag, the non-adhesive area extending over the tamper-evident tear-off strip. When the bag is to be opened for the first time, the label is adapted to be pulled away from the bag such that one adhesive area is fully lifted from the bag on one side of the opening. The tear-off strip can then be removed and the contents of the package accessed while the label remains adhered to the package by the other adhesive area on the other side of the opening. When the package is to be reclosed, the edges of the bag opening may be folded together and the said one adhesive area can be re-adhered to the package on the said one side of the opening to hold the two sides together. In this embodiment, the non-adhesive area acts as a hinge to allow the part of the label having the said one adhesive area to be pulled away from the bag. The package of the present invention is easy to operate and is adapted to be repeatedly opened and reclosed.

In a particularly preferred embodiment of the invention, the label may be provided with a further non-adhesive area on the said one face, the further non-adhesive area providing a portion which is easy to grip for pulling the label away from the bag.

An embodiment of the present invention will now be described in more detail, by way of example, with reference to the accompanying drawings, in which.

Figure 1:
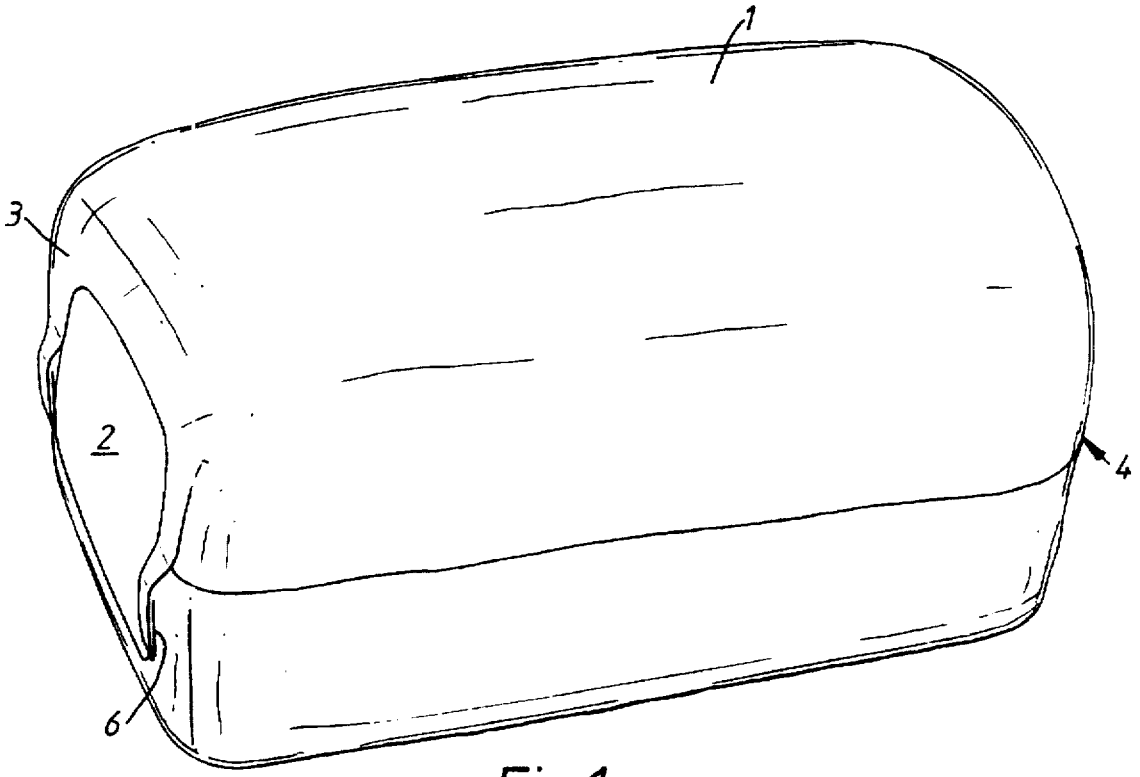
FIG. 1 is a perspective view of an embodiment of package according to the present invention.
Figure 2:
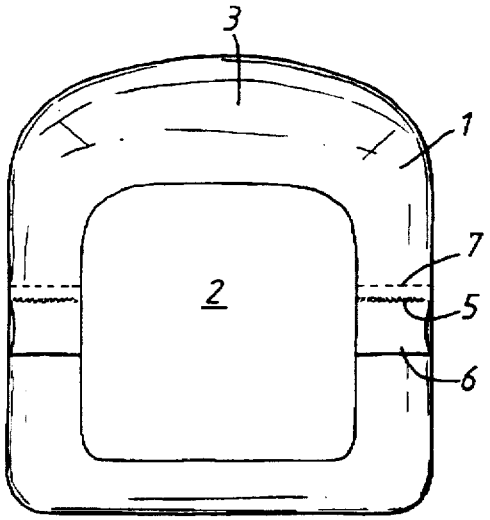
FIG. 2 is an end view of the package shown in FIG. 1.

Referring first to FIGS. 1 and 2, the package comprises a flexible plastics bag 1, which is preferably made of polyethylene or the like, and a label secured over one end 3 of the bag. The other end 4 of the bag is sealed and is not intended to be opened.

The end 3 of the bag is gusseted and heat sealed along line 5 to form a flap 6. A line of perforations 7 is provided across the flap, so that the flap 6 can be torn off to allow access to the contents of the bag 1.

Figure 3:
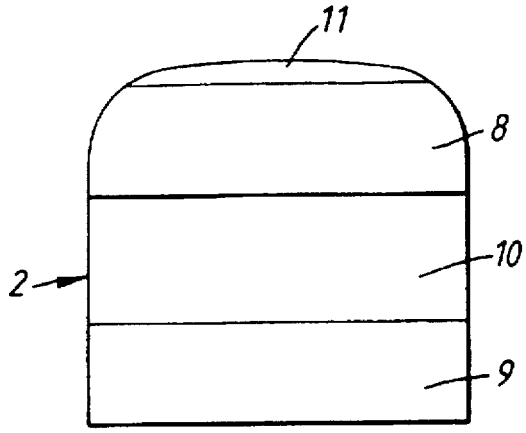
FIG. 3 is a reverse view of the label shown in FIG. 2.

Label 2 is adhered to the end of the bag across the flap, with the flap folded against the end of the bag. The reverse side of label 2 is shown in FIG. 3 and has an upper adhesive area 8 and a lower adhesive area 9 separated by a non-adhesive area 10. The label preferably also has on the reverse side an upper non-adhesive area 11. The label can be rectangular, square, circular, or any other appropriate shape such as that shown in FIG. 3.

Figure 4:
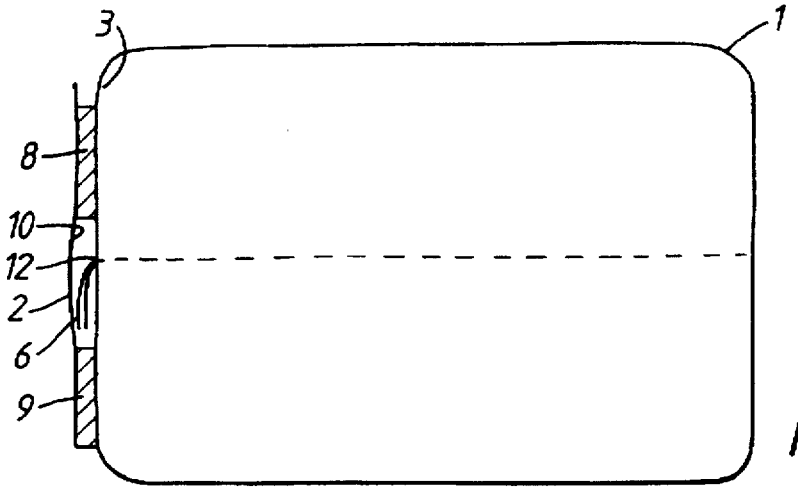
FIG. 4 is a schematic side view of the package of FIG. 1 prior to opening.

When the label 2 is adhered to the end 3 of the bag as shown in FIG. 4, the lower adhesive area 9 adheres to the lower part of the bag below seal line 5 and the upper adhesive area 8 adheres to the upper part of the bag above seal line 5 such that the middle non-adhesive area 10 extends over at least a part of the flap 6 and in the illustrated embodiment over the entire vertical extent of the flap as seen in FIG. 4. However, in a preferred embodiment (not shown) the flap may have a height of 20 mm, for example, while the height of non-adhesive area 10 is only 10 mm.

Figure 5:
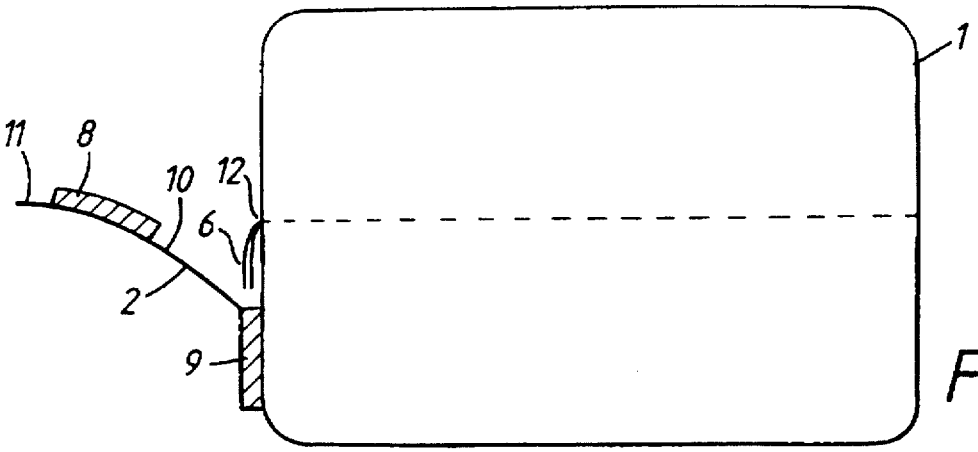
FIG. 5 is a schematic side view of the package of FIG. 1, the label having been pulled away.

In order to open the bag for the first time, the label is gripped at an edge and preferably at the upper edge and is pulled away from the bag. The non-adhesive area 11 enables the label to be gripped more easily. As the label is pulled, the adhesive area 8 is peeled away from the bag. When adhesive area 8 is fully released from the bag, as shown in FIG. 5, non-adhesive area 10 acts as a hinge to allow the label to be folded away from the bag without lifting adhesive area 9 from the lower part of the bag. Flap 6 is then freely accessible. Flap 6 can be removed by tearing across the line of perforations 7 to break the seal line 5. Bread can then be removed from the package through opening 12 as required. The package can then be reclosed by folding the upper and lower parts of the end 3 of the bag together and re-adhering adhesive area 8 to the upper part of the bag to hold the upper and lower parts together.

The package can then be repeatedly opened and closed as necessary, the label being easy to use. In addition the label can carry printed material such as, for example, the date and batch code information of the product, special offers and so on.

Preferably the adhesive areas 8, 9 comprise a removable, high performance acrylic adhesive for repeated use. Ideally, the adhesive will remain effective for up to three months in the freezer and in use on the bread package thereafter.

The label itself may be of polyvinyl chloride or polyethylene or any other suitable material, but polyethylene is preferred.

We claim:

1. A package comprising a flexible plastic bag and a label, the bag having a closed end, the closed end being openable to provide an opening for access to the contents of the package, wherein, the closed end of the package is initially sealed at a sealing area and, wherein, the sealing area is provided with a line of perforations to define the opening and reclosable by means of the label, the label having on one face two areas of adhesive separated by a non-adhesive area extending across substantially the whole width of the label, the adhesive areas being adapted to adhere to the package, one to each side of the line of perforations, such that the non-adhesive area extends over the line of perforations, wherein, the closed end of the package is initially sealed at a sealing area and, wherein, the sealing area is provided with a line of perforations.

2. A package according to claim 1, wherein the line of perforations forms an initial tamper-evident tear-off strip.

3. A package according to claim 2, wherein the label is initially positioned over the sealed end of the bag, the non-adhesive area extending over the tamper-evident tear-off strip, and the label being adapted to be pulled away from the bag such that one adhesive area is fully lifted from the bag on one side of the opening, the non-adhesive area acting as a hinge such that the label remains adhered to the package by the other adhesive area on the other side of the opening.

4. A package according to claim 1, wherein the label and the flexible bag are made from the same plastic material.

5. A package according to claim 4, wherein the plastic material is polyethylene.

* * * * *

UNITED STATES PATENT AND TRADEMARK OFFICE

CERTIFICATE OF CORRECTION

PATENT NO. : 5,741,075

DATED : April 21, 1998

INVENTOR(S) : Ross Collins et al.

It is certified that error appears in the above-identified patent and that said Letters Patent is hereby corrected as shown below:

Column 2, line 16, after "label" add --2--.

Column 3, line 13, after "perforations" delete the "," and add --.--

Signed and Sealed this

Twenty-second Day of September, 1998

*Attest:*

Bruce Lehman

BRUCE LEHMAN

*Attesting Officer*

*Commissioner of Patents and Trademarks*